US009397428B2

(12) United States Patent
Retho

(10) Patent No.: US 9,397,428 B2
(45) Date of Patent: Jul. 19, 2016

(54) ELECTRIC CONNECTOR WITH REDUCED INSERTION FORCE

(71) Applicant: HYPERTAC SA, Saint-Aubin-les-Elbeuf (FR)

(72) Inventor: Patrice Retho, Elbeuf (FR)

(73) Assignee: HYPERTAC SA, Saint-Aubin-les-Elbeuf (FR)

( * ) Notice: Subject to any disclaimer, the term of this patent is extended or adjusted under 35 U.S.C. 154(b) by 0 days.

(21) Appl. No.: 14/477,635

(22) Filed: Sep. 4, 2014

(65) Prior Publication Data

US 2015/0064986 A1 Mar. 5, 2015

(30) Foreign Application Priority Data

Sep. 4, 2013 (FR) ..... 13 58463

(51) Int. Cl.

| | |
|---|---|
| ***H01R 13/33*** | (2006.01) |
| ***H01R 13/40*** | (2006.01) |
| ***H01R 13/02*** | (2006.01) |
| ***H01R 13/03*** | (2006.01) |
| ***H01R 13/46*** | (2006.01) |
| ***H01R 13/187*** | (2006.01) |

(52) U.S. Cl.

CPC ..... *H01R 13/02* (2013.01); *H01R 13/03* (2013.01); *H01R 13/187* (2013.01); *H01R 13/33* (2013.01); *H01R 13/40* (2013.01); *H01R 13/46* (2013.01)

(58) Field of Classification Search

CPC ..... H01R 13/33; H01R 13/187; H01R 13/02; H01R 13/46; H01R 13/40

USPC ..... 439/733.1, 860

See application file for complete search history.

(56) References Cited

U.S. PATENT DOCUMENTS

| | | | | |
|---|---|---|---|---|
| 3,229,243 | A * | 1/1966 | Gomulka | H01R 13/40 439/733.1 |
| 3,750,094 | A * | 7/1973 | Zenkich | A61B 5/0416 24/676 |
| 4,390,223 | A * | 6/1983 | Zenkich | H01R 11/22 439/592 |
| 6,086,432 | A * | 7/2000 | Frinker | H01R 4/4863 439/841 |
| 8,025,539 | B2 * | 9/2011 | Hermannsson | A61B 5/04085 439/860 |
| 8,821,176 | B2 * | 9/2014 | Egloff | A61N 1/048 439/268 |
| 2002/0107555 | A1 | 8/2002 | Rusin et al. | |
| 2003/0109812 | A1 * | 6/2003 | Corl | A61B 17/2202 601/2 |
| 2005/0040930 | A1 * | 2/2005 | Dedert | G01F 23/36 338/160 |
| 2010/0197174 | A1 * | 8/2010 | Lahti | A61N 1/3752 439/733.1 |

FOREIGN PATENT DOCUMENTS

DE 3119218 A1 12/1982

* cited by examiner

*Primary Examiner* — Abdullah Riyami
*Assistant Examiner* — Harshad Patel
(74) *Attorney, Agent, or Firm* — Knobbe Martens Olson & Bear LLP

(57) ABSTRACT

An electric connector includes a base adapted to receive a plug, which is able to be plugged into the base along a longitudinal direction in the plugged position. The base and the plug define together an interstitial space. The connector also includes a contact member adapted to radially extend into the interstitial space when the plug is in the plugged position. The contact member is able to ensure electric contact between the plug and the base and includes a metal wire folded back on itself so as to form turns around the longitudinal direction. The turns are in a number of less than or equal to five. A set of electric connectors can include the electric connector and the plug.

11 Claims, 2 Drawing Sheets

ELECTRIC CONNECTOR WITH REDUCED INSERTION FORCE

CROSS-REFERENCE TO RELATED APPLICATION

This application claims priority to French Patent Application No. 13 58463 filed on Sep. 4, 2013, the disclosure of which including the specification, the drawings, and the claims is hereby incorporated by reference in its entirety.

BACKGROUND OF THE INVENTION (1) Field of the Invention

The present invention relates to an electric connector including:

- a base intended to receive a plug, the plug being able to be plugged into the base along a longitudinal direction in a plugged position, in which the base and the plug define together an interstitial space, and
- a contact member intended to radially extend in the interstitial space when the plug is in the plugged position, the contact member being able to ensure electric contact between the plug and the base.

(2) Description of Related Art

In order to achieve good electric contact between the plug and the base, the use of a contact member consisting of a fabric of conductive wires positioned around the longitudinal direction, on the plug or else in a housing of the base, is known from document FR-A-2 816 453. The fabric defines a large number of contact points in the plugged position between the base and the plug.

Alternatively, the use of a contact member consisting of a spring including a large number of hexagonal turns wound around the longitudinal direction, the spring filling a housing of the base, is also for example known from document DE-A-38 29 486.

However, such contact members although ensuring good electric contact sometimes make the insertion of the plug into the base or the withdrawal of the plug from the base, mechanically difficult.

An object of the invention is to provide a set of connectors which is simpler to apply, while remaining simple to make.

BRIEF SUMMARY OF THE INVENTION

For this purpose, the object of the invention is an electric connector comprising:

- a base intended to receive a plug, the plug being able to be plugged into the base along a longitudinal direction in a plugged position, in which the base and the plug define together an interstitial space, and
- a contact member intended to radially extend in the interstitial space when the plug is in the plugged position, the contact member being able to ensure electric contact between the plug and the base, the contact member comprising a metal wire folded back on itself in order to form turns around the longitudinal direction, the number of turns being less than or equal to five, preferably less than or equal to two.

According to particular embodiments, the electric connector comprises one or more of the following features, taken individually or according to all the technically possible combinations:

- the metal wire includes a plurality of bends, the bends respectively including first areas of the contact member in contact with an inner surface of the base, the inner surface being substantially cylindrical along the longitudinal direction defining an external diameter of the interstitial space, the first contact areas preferably being five in number;
- any two consecutive first contact areas taken from the first contact areas, in a projection on a transverse plane perpendicular to the longitudinal direction, are separated by a distance greater than or equal to 60% of the external diameter;
- the bends, in a transverse plane perpendicular to the longitudinal direction, have a radius of curvature of less than or equal to 30% of the external diameter;
- the metal wire includes a plurality of substantially rectilinear portions intended to respectively include in the plugged position, second contact areas of the contact member with an outer surface of the plug, the second contact areas preferably being five in number;
- the metal wire comprises at least 90% by mass of an alloy consisting of copper and beryllium;
- the metal wire is covered with a layer comprising at least 90% by mass of a material selected from gold and from a gold and nickel alloy.

The invention also relates to a set of electric connectors comprising an electric connector as defined above, and a plug able to be plugged into the base in the plugged position.

According to a particular embodiment, the set of electric connectors is such that the plug comprises a substantially cylindrical outer surface along the longitudinal direction, the outer surface defining in the plugged position, an internal diameter of the interstitial space, the ratio of the internal diameter over the external diameter being less than or equal to 0.6, preferably less than or equal to 0.5.

BRIEF DESCRIPTION OF THE SEVERAL VIEWS OF THE DRAWINGS

The invention will be better understood upon reading the description which follows only given as an example, and made with reference to the appended drawings, wherein.

DETAILED DESCRIPTION OF THE INVENTION

Figure 1:
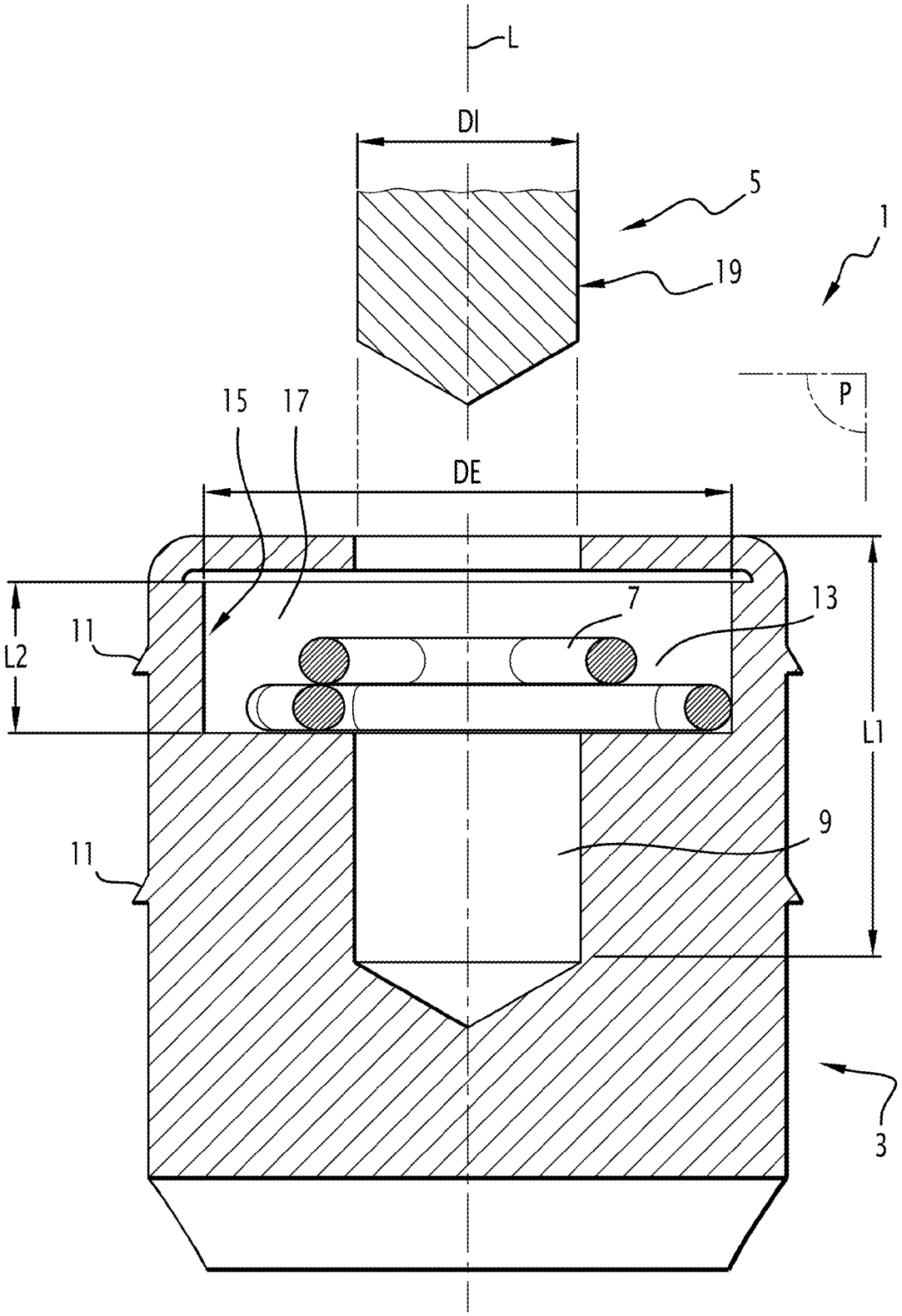
FIG. 1 is a sectional view along a plane passing through the longitudinal direction of a set of connectors according to the invention, the set being in an unplugged position.

With reference to FIG. 1, a set of electric connectors 1 according to the invention is described. The set of electric connectors 1 comprises a female base 3 intended to be connected to a first electric circuit (not shown), and a male plug 5 able to be plugged into the base 1 along a longitudinal direction L, the plug 5 being intended to be connected to a second electric circuit (not shown). The set of electric connectors 1 also comprises a contact member 7.

The base 3 for example has the general shape of a socket. The base 3 consists of a copper alloy, for example brass. The base 3 advantageously has axial symmetry around the longitudinal direction L.

The base 3 defines a housing 9 for receiving the plug 5.

The base 3 advantageously includes external prongs 11 intended to allow its attachment on a frame (not shown). According to an alternative not shown, the base 3 is attached on said frame by means of a clip.

The base 3 includes a recess 13 receiving the contact member 7. The base 3 includes an inner contact surface 15 axially located at the bottom of the recess 13.

The housing 9 longitudinally extends over a length L1 for example comprised between 0.1 and 0.5 mm. The housing 9 has an adapted shape for cooperating with the plug 5 by plugging, along the longitudinal direction L.

By <<plugging>>, is meant the insertion of the plug 5 into the base 3 with the purpose of making an electric contact between both of these elements.

The recess 13 has a length L2 along the longitudinal direction L representing a fraction of the length L1, for example about one third. The recess 13 is advantageously substantially cylindrical around the longitudinal direction L.

In FIG. 1, the plug 5 is illustrated away from the base 3, in an unplugged position. The plug 5 has a general cylindrical shape. When the plug 5 is plugged into the base 3 in a plugged position (not shown), it defines with the base 3 an interstitial space 17. The plug 5 includes an outer contact surface 19.

The interstitial space 17 is ring-shaped around the longitudinal direction L. The interstitial space 17 extends between the inner contact surface 15 of the base 3 and the outer contact surface 19 of the plug 5. The interstitial space 17 for example has a rectangular section along radial sectional planes P (FIG. 1).

The inner contact surface 15 of the base 3 defines an external diameter DE of the interstitial space 17, advantageously comprised between 0.9 and 2 mm, for example between 1.0 and 1.3 mm.

The outer contact surface 19 of the plug 5 defines an internal diameter DI of the interstitial space 17, advantageously comprised between 0.3 et 0.7 mm, for example between 0.4 and 0.5 mm.

The DI/DE ratio is advantageously less than or equal to 0.6, for example less than or equal to 0.5.

Figure 2:
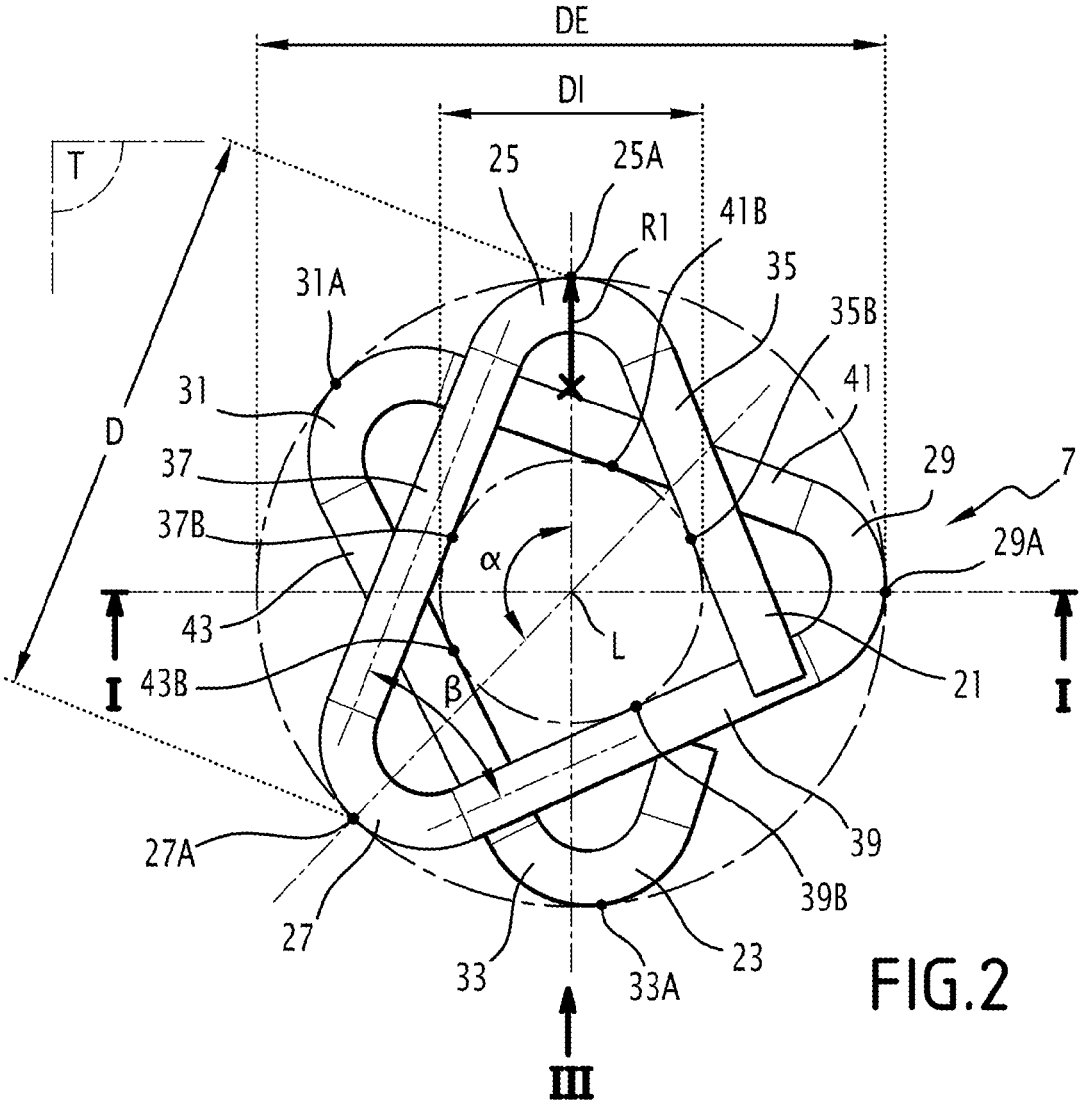
FIG. 2 is a front view, along the longitudinal direction, of the contact member of the set illustrated in FIG. 1.
Figure 3:
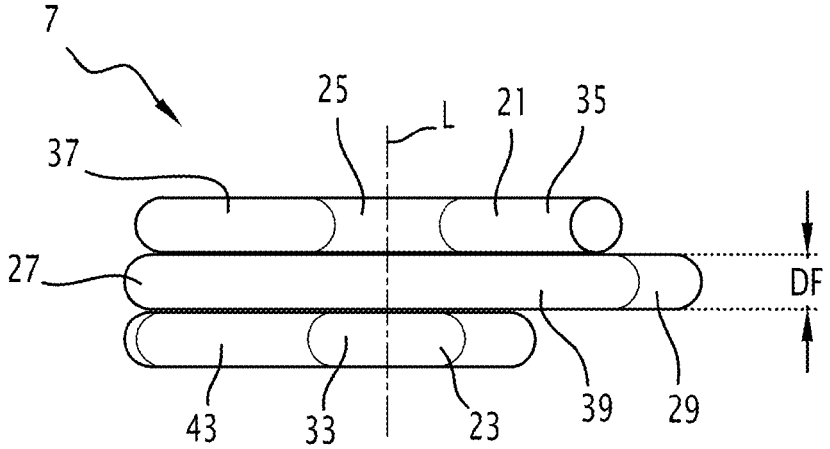
FIG. 3 is a profile view of the contact member illustrated in FIGS. 1 and 2.

As visible in FIGS. 2 and 3, the contact member 7 consists of a metal wire folded back on itself in order to form turns 21, 23 around the longitudinal direction L.

By <<turn>>, is meant a portion of the wire substantially completing full rotation around the longitudinal direction L.

The contact member 7 advantageously comprises a number of turns of less than or equal to five, preferably less than or equal to two. In the illustrated example, the contact member 7 comprises two turns 21 and 23.

The metal wire which the contact member 7 consists of is for example cylindrical.

According to a particular embodiment, the metal wire comprises at least 90% by mass of an alloy consisting of copper and beryllium. Advantageously, the metal wire is covered with a layer comprising at least 90% by mass of a material selected from gold or from a gold and nickel alloy.

The metal wire has a wire diameter DF (FIG. 3) advantageously comprised between 0.05 and 0.2 mm, for example between 0.9 and 0.12 mm.

The metal wire forms a plurality of successive bends 25, 27, 29, 31, 33 (FIG. 2). The metal wire further comprises a plurality of substantially rectilinear portions 35, 37, 39, 41, 43. In the illustrated example, the metal wire successively comprises the portion 35, the bend 25, the portion 37, the bend 27, the portion 39, the bend 29, the portion 41, the bend 31, the portion 43, and the bend 33.

In the unfolded condition (not shown), the metal wire has a length (not shown) advantageously comprised between 3 and 10 mm, for example between 4 and 6 mm.

The bends 25, 27, 29, 31, 33 are for example five in number.

Any two successive bends taken from among the bends 25, 27, 29, 31, 33 are angularly spaced apart around the longitudinal direction L by an angle $\alpha$ with a value of about 135°. In other words, the bends 25, 27, 29, 31, 33 are for example respectively located at about 0°, 135°, 270°, 405°, 540° with respect to the longitudinal direction L. Each bend 25, 27, 29, 31, 33 forms an angle $\beta$ of about 45°.

Each bend 25, 27, 29, 31, 33, in the plugged position, includes a contact surface forming a first contact area 25A, 27A, 29A, 31A, 33A with the inner surface 15 of the base 3.

The first contact areas 25A, 27A, 29A, 31A, 33A are substantially point-like.

The first contact areas 25A, 27A, 29A, 31A, 33A for example, in a plane T perpendicular to the longitudinal direction L, have a radius of curvature R1 of less than or equal to 30% of the external diameter DE.

Any two first consecutive contact areas taken from the first contact areas 25A, 27A, 29A, 31A, 33A, in a projection on the plane T, are separated by a distance D greater than or equal to 60% of the external diameter DE.

The portions 35, 37, 39, 41, 43 are for example five in number.

The portions 35, 37, 39, 41, 43 respectively comprise contact surfaces forming, in the plugged position, second contact areas 35B, 37B, 39B, 41B, 43B between the contact member 7 and the outer surface 19 of the plug 5.

The second contact areas 35B, 37B, 39B, 41B, 43B are advantageously five in number and for example substantially point-like.

The operation of the set of connectors 1 will now be described.

In order to put the first electric circuit (not shown) in electric contact with the second electric circuit (not shown), the plug 5 is plugged into the base 3 along the longitudinal direction L.

In the plugged position, the contact member 7 makes an electric contact between the plug 5 and the base 3, therefore between the first circuit and the second circuit, mentioned above.

Each first contact area 25A, 27A, 29A, 31A, 33A is in electric contact with the inner surface 15 of the base 3. Each second contact area 35B, 37B, 39B, 41B, 43B is in contact with the outer surface 19 of the plug 5.

By means of the characteristics described above, the number of second contact areas 35B, 37B, 39B, 41B, 43B is reduced. The force for inserting the plug 5 into the base 3 is reduced relatively to the aforementioned sets of the prior art. The set of connectors 1 is moreover simple to make.

Further, as the second contact areas 35B, 37B, 39B, 41B, 43B are not aligned with each other along the longitudinal direction L, the wear caused by the contact member 7 on the plug 5 is less than the one caused by the contact members of the prior art having longitudinal alignments of the second contact areas. This gives the possibility of ensuring an electric contact of good quality for a longer time Finally, as the contact member 7 has a reduced number of turns, for example two turns, the longitudinal extension of the contact member 7 is reduced. This allows reduction in the length L2 of the recess 13 and in the length L1 of the housing 9.

What is claimed is:

1. An electric connector comprising:

a base adapted to receive a plug, which is adapted to be plugged in to the base along a longitudinal direction in a plugged position, wherein the base and the plug together define an interstitial space, and a contact member adapted to radially extend in the interstitial space when the plug is in the plugged position, the contact member ensuring electric contact between the plug and the base, the contact member comprising a metal wire folded back on itself so as to form turns around the longitudinal direction, and the number of turns being less than or equal to five, wherein the metal wire comprises a plurality of bends, each bend comprising a first contact area that contacts an inner surface of the base, the inner surface being substantially cylindrical along the longitudinal direction and defining an external diameter of the interstitial space, and wherein any two consecutive first contact areas taken from the first contact areas, in a projection on a transverse plane perpendicular to the longitudinal direction, are separated by a distance greater than or equal to 60% of the external diameter.

2. The electric connector according to claim 1, wherein the bends in a transverse plane perpendicular to the longitudinal direction, have a radius of curvature less than or equal to 30% of the external diameter.

3. The electric connector according to claim 1, wherein the metal wire includes a plurality of substantially rectilinear portions, each substantially rectilinear portion comprising, in the plugged position, a second contact area that contacts an outer surface of the plug.

4. The electric connector according to claim 3, wherein the metal wire includes five second contact areas.

5. The electric connector according to claim 1, wherein the metal wire comprises at least 90% by mass of an alloy of copper and beryllium.

6. The electric connector according to claim 1, wherein the metal wire is covered with a layer comprising at least 90% by mass of a material selected from gold or from a gold and nickel alloy.

7. A set of electric connectors comprising an electric connector according to claim 1, and a plug able to be plugged into the base in the plugged position.

8. The set of electric connectors according to claim 7, wherein the plug comprises an outer substantially cylindrical surface along the longitudinal direction, the outer surface defines, in the plugged position, an internal diameter of the interstitial space, and the ratio of the internal diameter to the external diameter is less than or equal to 0.6.

9. The set of electric connectors according to claim 7, wherein the ratio of the internal diameter over the external diameter is less than or equal to 0.5.

10. The electric connector according to claim 1, wherein the number of turns is less than or equal to two.

11. The electric connector according to claim 1, wherein the metal wire includes five first contact areas.

* * * * *